US006913788B2

(12) United States Patent
Walter

(10) Patent No.: US 6,913,788 B2
(45) Date of Patent: Jul. 5, 2005

(54) PROCESS AND APPARATUS FOR CHROMING AN INNER SURFACE OF A COMPONENT

(75) Inventor: Heinrich Walter, Friedberg (DE)

(73) Assignee: MTU Aero Engines GmbH, Munich (DE)

( * ) Notice: Subject to any disclaimer, the term of this patent is extended or adjusted under 35 U.S.C. 154(b) by 210 days.

(21) Appl. No.: 09/915,765

(22) Filed: Jul. 27, 2001

(65) Prior Publication Data

US 2002/0025376 A1 Feb. 28, 2002

(30) Foreign Application Priority Data

Jul. 27, 2000 (DE) ..... 100 36 620

(51) Int. Cl.[7] ..... C23C 16/08
(52) U.S. Cl. ..... 427/237; 427/253
(58) Field of Search ..... 427/253, 237

(56) References Cited

U.S. PATENT DOCUMENTS

| | | | | |
|---|---|---|---|---|
| 4,132,816 A | | 1/1979 | Benden et al. | |
| 4,148,275 A | * | 4/1979 | Benden et al. | 118/715 |
| 6,120,843 A | * | 9/2000 | Pillhoefer et al. | 427/253 |

FOREIGN PATENT DOCUMENTS

| | | | | |
|---|---|---|---|---|
| EP | 349420 | | 1/1990 | |
| EP | 696649 | | 2/1996 | |
| FR | 84334416 | | 4/1938 | |
| FR | 2024463 | | 8/1970 | |
| FR | 2576917 | | 8/1986 | |
| GB | 363954 | | 5/1930 | |
| GB | 783953 | | 10/1957 | |
| GB | 1549845 | | 8/1979 | |
| GB | 2328219 A | * | 2/1999 | C23C/10/06 |

OTHER PUBLICATIONS

European Search Report and translation thereof (Nov. 2001).
English Abstract of Shishkov, R. et al. Abstract No. 196855, no date.

* cited by examiner

*Primary Examiner*—Timothy Meeks
(74) *Attorney, Agent, or Firm*—Crowell & Moring LLP

(57) ABSTRACT

A process for chroming an inner surface of a component, in which the inner surface which is to be coated is not brought into contact with a powder which forms the coating gas, includes: providing a mixture of chromium granules and an activator; heating the mixture to a temperature at which a coating gas which substantially comprises gaseous CrCl is formed; dissipating the coating gas; and exposing the inner surface of the component to the coating gas thereby forming a chromium-containing diffusion layer.

8 Claims, 2 Drawing Sheets

PROCESS AND APPARATUS FOR CHROMING AN INNER SURFACE OF A COMPONENT

BACKGROUND AND SUMMARY OF INVENTION

This application claims the priority of German application No. 100 36 620.1, filed Jul. 27, 2000, the disclosure of which is expressly incorporated by reference herein.

The present invention relates to a process and an apparatus for chroming an inner surface, in particular a cavity, of a metallic component.

To save weight or for cooling purposes, metallic components, such as turbine blades of stationary gas turbines or aircraft engines, can be of hollow design and have a cavity with an inner surface. In the case of turbine blades, the inner surface has to be chromed, on account of the risk of corrosion or sulfuration caused by sulphur.

A powder pack process for chroming the inner surface of the cavity of turbine blades is known, in which a powder mixture comprising $Al_2O_3$, chromium and an activator, such as $NH_4Cl$, is introduced into the cavity. When the powder mixture is heated while hydrogen is being supplied, chromium is deposited, so as to form a chromium-containing diffusion layer. The introduction and removal of the powder mixture into and from the cavity have proven to be drawbacks of this process. During introduction, the complete covering of the inner surface of the cavity which is required in order to form a continuous diffusion layer causes problems in particular with complicated geometry or sharp edges. After the process, it is difficult to remove the powder pack from the cavities without leaving any residues. Powder residues often adhere to the inner surface of the cavity.

The object of the present invention is to provide a process in which an inner surface which is to be coated does not have to be brought into contact with a powder which forms the coating gas. Furthermore, it is intended to provide an apparatus for chroming an inner surface of a component.

With regard to the process, the solution according to the present invention is characterized by the following steps:

(1) providing a mixture of chromium granules and an activator;

(2) heating the mixture to a temperature at which a substantially gaseous coating gas comprising CrCl is formed;

(3) dissipating the coating gas; and (4) exposing the inner surface of the component to the coating gas so as to form a chromium-containing diffusion layer.

The advantage of the process is that the coating of the inner surface of the cavity takes place in the gas phase. Therefore, the introduction of a powder mixture into the cavity at the start of the process and the removal of the powder pack after the coating has been carried out are eliminated. Moreover, it is impossible for any powder residues to adhere to the coated surface of the cavity. The mixture, which substantially comprises granules, e.g. with a particle size of 5–20 mm, can be processed more rapidly and more economically than a powder mixture comprising a donor powder and a filler powder for preventing sintering. The granules do not cause any blockages which could impede the dissipation of the coating gas. Moreover, the granules are broken down gradually and do not have to be exchanged after each coating process, as is the case with a powder.

The mixture can be prepared using approximately 99% by weight of chromium granules and approximately 1% by weight of activator, it being possible for the activator to be, for example, $NH_4Cl$ in powder form.

To form the coating gas, the mixture can be heated at a temperature of approximately 1200° C.

The dissipation of the coating gas from the container and the step of exposing the inner surface of the component which is to be coated may take place automatically under the action of the force of gravity, since the coating gas, which substantially comprises CrCl, has a higher density or weight than the gases of the atmosphere, such as the inert gas. Therefore, the heating continuously generates coating gas without further measures for generating or influencing the flow being required.

The process can be carried out in an inert environment, in which case, by way of example, Ar is used for purging purposes.

The component used may be a hollow turbine blade, the cavity of which serves to save weight or is for cooling purposes and the surface of which has to be protected against corrosion and/or sulfuration. The latter occurs in particular with hollow, uncooled gas turbine components.

To ensure reliable protection against corrosion and sulfuration, the diffusion layer is formed with a layer thickness in the region of 25 $\mu$m and a chromium content in the range from 17% to 20%.

Furthermore, according to the present invention an apparatus is provided having a container for accommodating a mixture of chromium granules and an activator, such as $NH_4Cl$ in powder form. At the bottom of the container, there is at least one outlet for a coating gas. A device for holding the component in such a way that the outlet of the container is positioned in the region of the inner surface of the component is also provided. It is possible for the apparatus to be arranged in a heatable retort for heating the mixture which is in the container to a temperature at which a coating gas which substantially comprises CrCl is formed.

To ensure advantageous dissipation of the coating gas, the base of the container may slope downwards towards the outlet or, for example, may also be of funnel-shaped design.

Furthermore, the shape of the outlet may be matched to the shape of a cavity in the component which has the inner surface, so as to ensure that the inner surface is completely exposed, without losses, to the coating gas.

To create an inert atmosphere, the retort may have a gas-feed device and a gas-discharge device for an inert gas, such as for example Ar, which is supplied and removed again for the purpose of purging the apparatus.

For relatively long coating times in the pulverulent activator, such as $NH_4Cl$, is initially present in the mixture in an insufficient amount, the container may have a feed line 1*b* as shown in FIG. 1 for the activator which is in powder or in particular also gas form, through which line, for example, a mixture of HCl and Ar can be passed, with the result that further coating gas which substantially comprises CrCl is formed.

To improve the economic viability, a multiplicity of apparatuses may be arranged in the retort, in order to allow the simultaneous coating of a plurality of components. For this purpose, the apparatus may also have a plurality of outlets at the base.

Other objects, advantages and novel features of the present invention will become apparent from the following detailed description of the invention when considered in conjunction with the accompanying drawings.

DETAILED DESCRIPTION OF DRAWINGS

Figure 1:
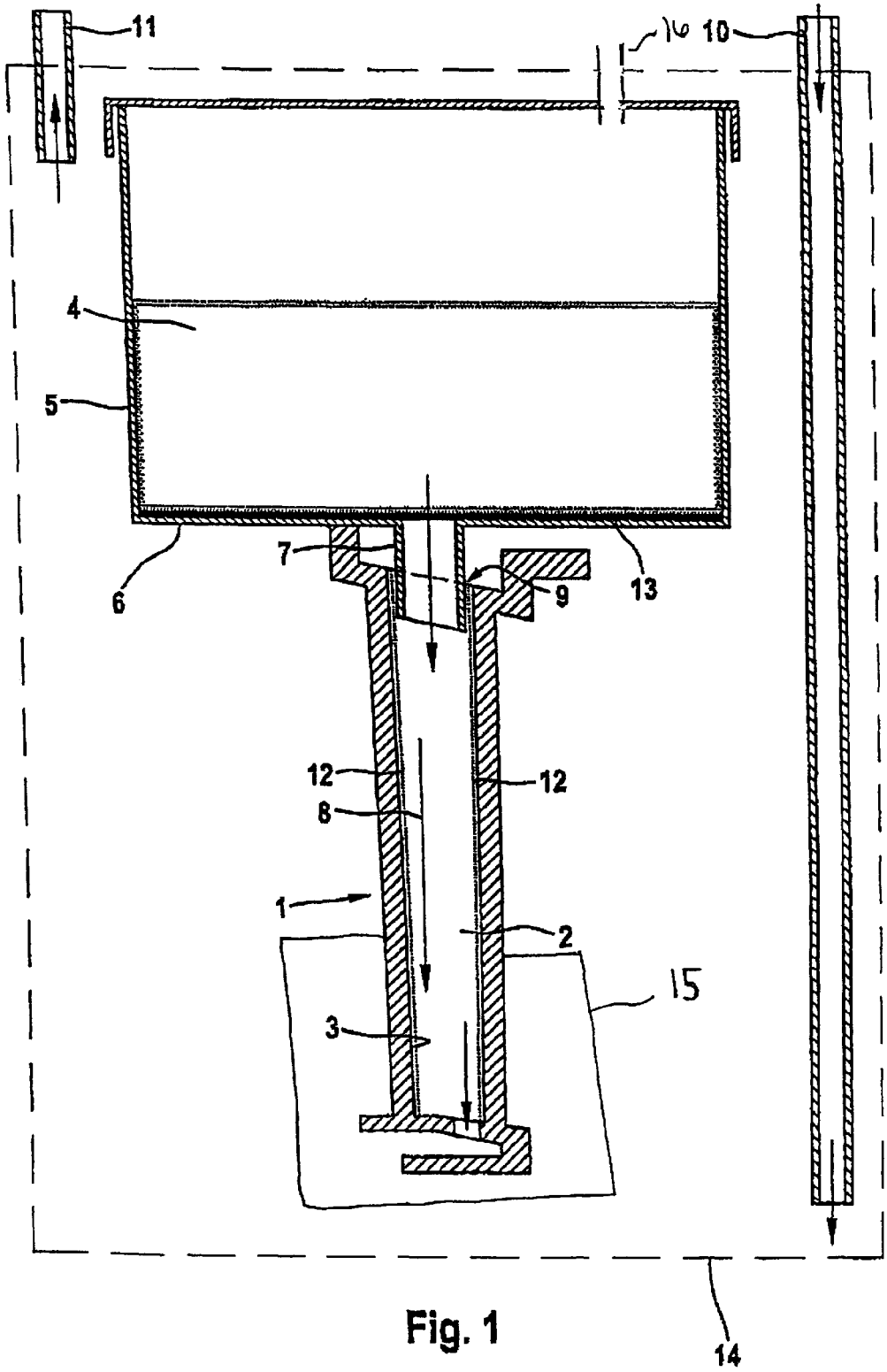
FIG. 1 diagrammatically depicts a side view of an apparatus which can be used for the gas-phase chroming of a cavity of a component.

FIG. 1 diagrammatically depicts an apparatus for chroming an inner surface 3 of a cavity 2 of a metal component 1. The metal component 1 may be a turbine blade which has a cavity 2 with an inner surface 3. The mixture 4 of chromium granules and $NH_4Cl$ as pulverulent activator, which forms the subsequent coating gas, is introduced into a container 5 of the apparatus, where it fills approximately half the volume of the container 5, which is, for example, approximately 8–10 liters, as can be seen from the dotted line representing the mixture 4. At a bottom 6 of the container 5, there is an outlet 7, through which a coating gas, which is indicated by arrows 8, is dissipated from the container 5 during the gas-phase chroming.

Approximately 99% by weight of the mixture 4 consists of chromium granules with a particle size of between 5–20 mm, and approximately 1% by weight of the mixture 4 consists of the activator in powder form. The apparatus is inserted into a retort 14 and is purged with 1000 l/h of Ar in order to create an inert atmosphere. There are spaces between the particles of the granules.

The turbine blade 1 is positioned in a holding device 15 in such a way that the outlet 7 of the container 5 is arranged in the region of an opening 9 in the cavity 2 of the turbine blade 1. In an embodiment, the shape of the outlet 7 of the opening 9 is matched to the cavity 2 such that the outlet 7 projects into the cavity 2, thus ensuring optimum flow of the coating gas 8 through the cavity 2 and optimum exposure of the inner surface 3 of the turbine blade 1 to the coating gas. The retort 14 has a heater (not shown), which the mixture 4 in the container 5 is heated at a temperature at which the coating gas 8, which substantially comprises CrCl, is formed.

FIG. 1 also shows a gas-supply device 10, by which, as can be seen from the arrows, an inert gas, such as Ar, is supplied, by which the entire apparatus is purged so as to create an inert atmosphere in the retort 14. The inert gas is discharged continuously via a device 11, as indicated by an arrow.

In the gas-phase chroming process, the mixture 4 of chromium granules and $NH_4Cl$ as activator which is provided in the container 5 is heated, by a heater arrangement, to a temperature of approximately 1200° C., so that coating gas which substantially comprises gaseous CrCl is formed. The coating gas 8 has a greater density or weight than the surrounding Ar or $H_2$ and, on account of the force of gravity, automatically and continuously flows through the outlet 7 at the base 6 of the container 5, in this way is passed to the cavity 2 of the turbine blade 1 and then acts on the surface 2 of this blade so as to form a chromium-containing diffusion layer, which is indicated by a dotted line in FIG. 1.

On account of the coating gas 8 being formed continuously and flowing downwards through the outlet 7 under the force of gravity, the process proceeds automatically. The coating temperature is maintained for a period which is to be varied as a function of the desired layer thickness. In the present configuration of the process, the coating temperature is maintained for 10 h. In this case, a chromium-containing diffusion layer 12 with a layer thickness of 25 $\mu$m and a chromium content of 17% is formed.

Liquid CrCl can be deposited at the base 6 of the container 5, as indicated by a thick line denoted by 13.

Figure 2:
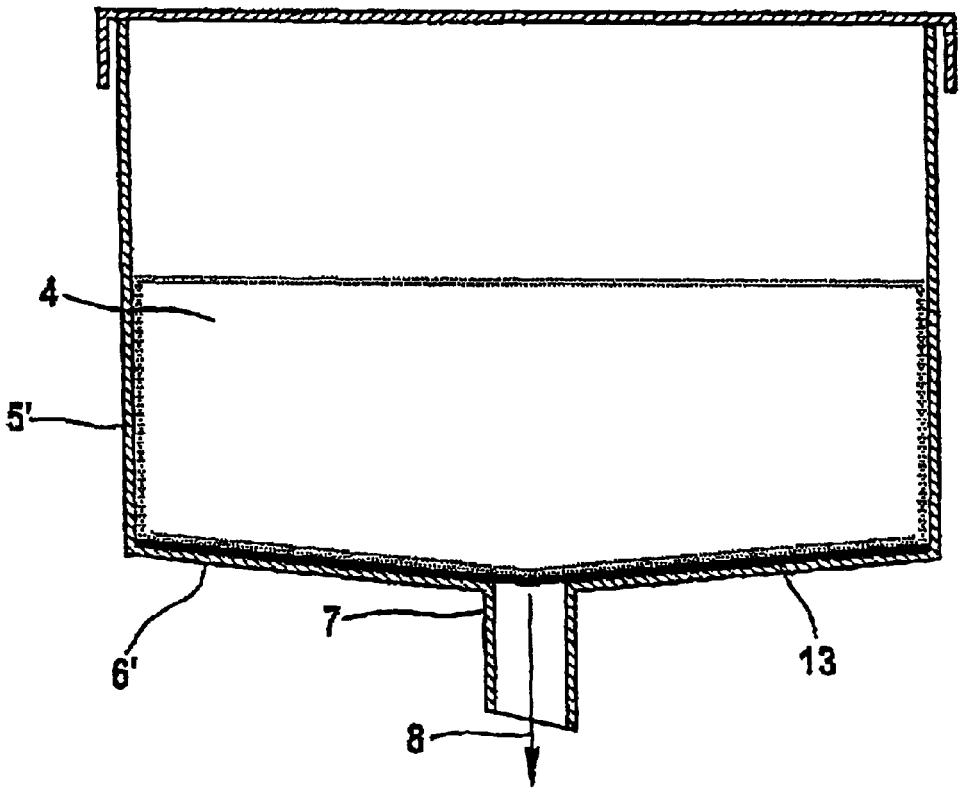
FIG. 2 diagrammatically depicts a side view of an alternative embodiment of the container of the apparatus shown in FIG. 1.

FIG. 2 diagrammatically depicts an alternative embodiment of the apparatus, in which only a modified container 5' is illustrated. In this case too, a mixture 4 of chromium granules and an activator, such as for example $NH_4Cl$, is introduced into the container 5', the mixture 4 consisting, for example, of approximately 99% by weight of chromium granules and approximately 1% by weight of $NH_4Cl$.

The modification of the container 5' consists in the funnel-shaped base 6', which slopes downwards towards the outlet 7 provided in the center of the funnel. In the same way as in the embodiment illustrated in FIG. 1, the coating gas, which is indicated by the arrow 8, after the mixture 4 has been heated to the coating temperature of approximately 1100° C., flows through the outlet 7 and in this way is passed into the cavity of the metallic component so as to act on the inner surface of this component. On account of the funnel-shaped design of the base 6', the gaseous CrCl and the liquid CrCl which may form can be discharged or stream or flow out through the outlet 7 more successfully, and can also reach the cavity and its inner surface and can assist with the formation of the chromium-containing diffusion layer.

For the simultaneous coating of a plurality of components 1, the containers 5 shown in FIG. 1 and FIG. 2 may each have a plurality of outlets 7 at the base 6. It is also possible for a plurality of apparatus to be fitted in a retort 14 for this purpose.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for chroming an inner surface of a component, comprising:

providing a mixture of chromium granules and an activator;

heating the mixture to a temperature to form a substantially gaseous product which is a coating gas comprising CrCl;

dissipating the coating gas; and exposing the inner surface of the component to the coating gas, thereby forming a chromium-containing diffusion layer, wherein the dissipating of the coating gas and the exposing of the inner surface of the component occur automatically by the force of gravity.

2. A process according to claim 1, wherein the mixture comprises approximately 99% by weight of the chromium granules and approximately 1% by weight of the activator.

3. A process according to claim 1, wherein the activator is $NH_4Cl$ or HCl.

4. A process according to claim 1, wherein the heating of the mixture is at a temperature of approximately 1200° C.

5. A process according to claim 1, wherein the process is carried out in an inert environment.

6. A process according to claim 1, wherein the component is a hollow turbine blade.

7. A process according to claim 1, wherein the chromium-containing diffusion layer has a thickness of about 25 mm.

8. A process according to claim 1, wherein the chromium-containing diffusion layer has a chromium content in a range from 17% to 20%.

* * * * *